US005603622A

United States Patent [19]

Lin

[11] Patent Number: 5,603,622

[45] Date of Patent: Feb. 18, 1997

[54] TRACK LIGHT MOUNTING ARRANGEMENT

[75] Inventor: Acer Lin, Taipei, Taiwan

[73] Assignee: Taiwan King Prince Co., Ltd., Taipei, Taiwan

[21] Appl. No.: 405,867

[22] Filed: Mar. 17, 1995

[51] Int. Cl.[6] ..... H01R 25/00

[52] U.S. Cl. ..... 439/121; 439/116

[58] Field of Search ..... 439/110–121, 207–212

[56] References Cited

U.S. PATENT DOCUMENTS 4,108,523 8/1978 Bolis ..... 439/116

4,429,934 2/1984 VandenHoek et al. ..... 439/207

4,533,190 8/1985 Booty ..... 439/110

*Primary Examiner*—David L. Pirlot

*Attorney, Agent, or Firm*—Varndell Legal Group

[57] ABSTRACT

A track light mounting arrangement includes a plurality of tracks fastened to locating frames, a plurality of electric boxes slidably coupled to the tracks to hold a respective lamp assembly, a plurality of sliding switches respectively coupled to the electric boxes and moved forward to turn on the respective lamp assemblies or backward to turn them off. Circular distribution boxes may be installed for coupling tracks radially by connecting devices, so that a plurality of track lights can be electrically connected and arranged in all directions.

2 Claims, 10 Drawing Sheets

TRACK LIGHT MOUNTING ARRANGEMENT

BACKGROUND AND SUMMARY OF THE INVENTION

The present invention relates to a track light and more particularly, a track light mounting arrangement which permits a plurality of track lights to be conveniently installed and arranged in desired directions.

Various track lights have been disclosed and have appeared on the market. These track lights must be installed with transformers so that a direct current power supply can be obtained from an alternating current power supply through the transformers. Due to the power limitation of transformers, the total power consumption of a set of track lights can not surpass the capacity of the matched transformer. The limitation allows only a limited quantity of track lights to be connected together. Furthermore, when several sets of track lights are to be installed together, the arrangement of the transformers greatly complicates the electric wiring and the installation procedure.

The present invention has been accomplished in view of the above circumstances in view. According to one aspect of the present invention, couplers are provided for coupling tracks together so that a plurality of lamp assemblies can be installed without causing the problem of overvoltage. According to another aspect of the present invention, a circular distribution box can be used to connect a plurality of tracks in radial directions by couplers and connecting devices, so that a plurality of track lights can be arranged on the wall in all directions. According to still another aspect of the present invention, a sliding switch is provided to control the operation of the respective track light positively and smoothly.

DETAILED DESCRIPTION OF THE PREFERRED EMBODIMENT

Figure 1:
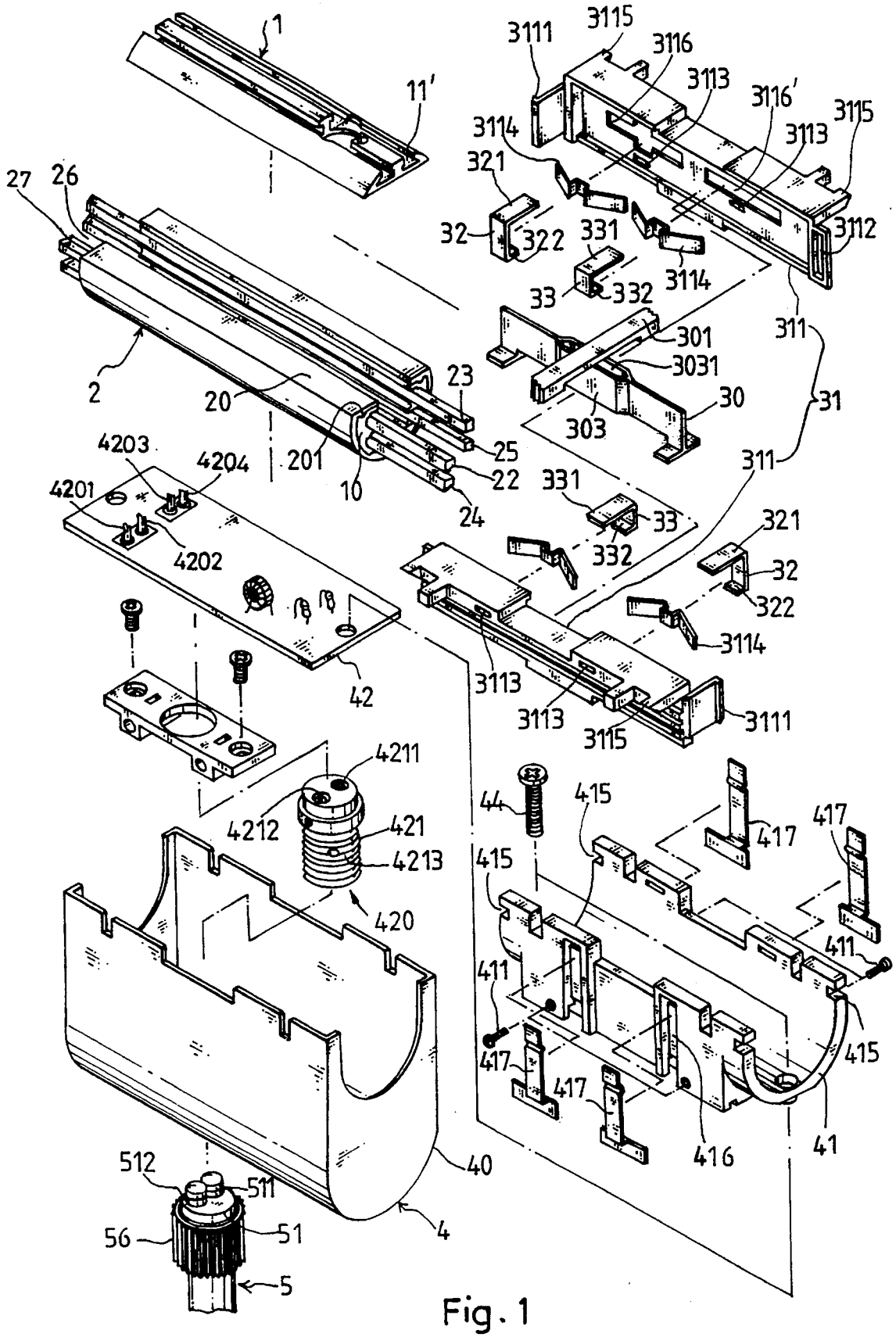
FIG. 1 is an exploded view of a track light according to the present invention.
Figure 2:
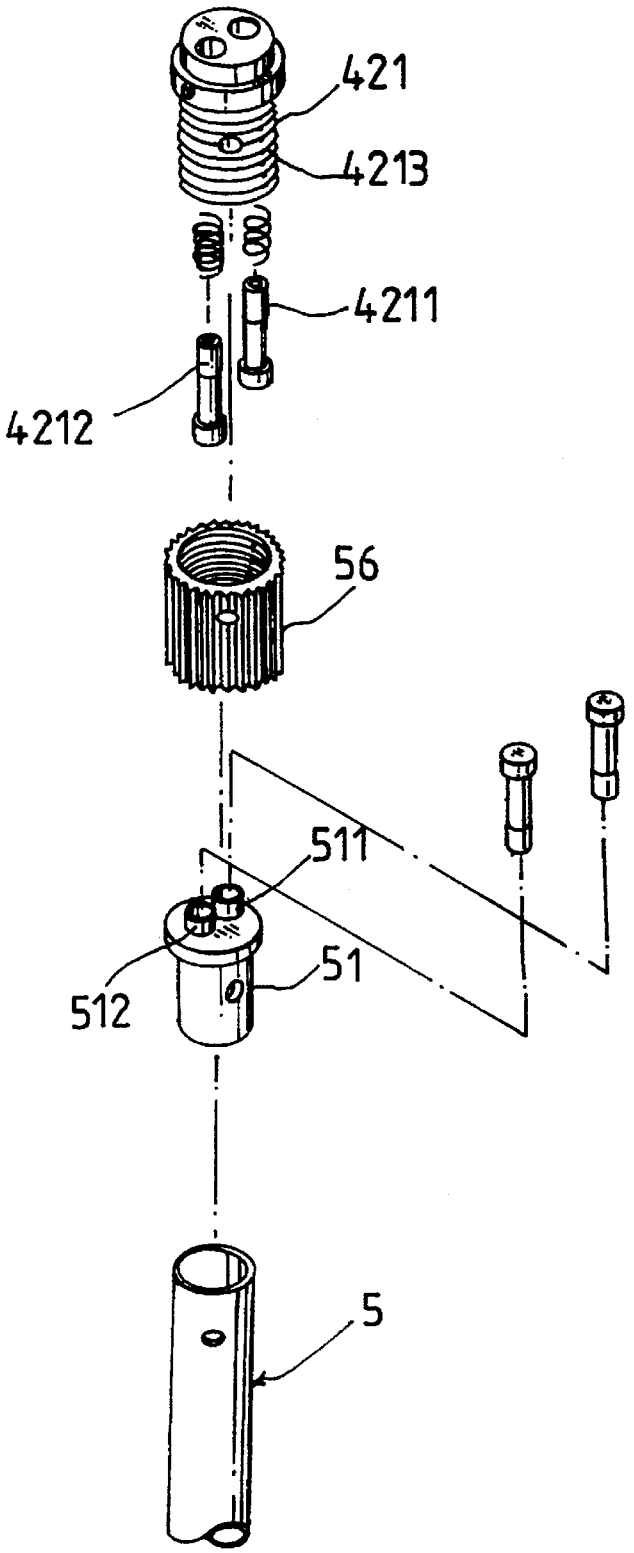
FIG. 2 is an exploded view of the electric connector for the electric box and the electric connector for the lamp assembly according to the present invention.

Referring to FIGS. 1 through 12, a track light in accordance with the present invention is generally comprised of a locating frame 1, a track 2, a sliding switch 3, an electric box 4, a lamp assembly 5, and a coupler 6. The electric box 4 comprises a transformer (not shown), metal contact plates (not shown), and other electric parts for providing power supply to the track light for operation.

The locating frame 1 comprises two opposite retaining grooves 11', which receive two opposite projection strips 61 of the coupler 6. When the projecting strips 61 are respectively fastened to the retaining grooves 11', the locating frame 1 can then be coupled to the track 2 by the coupler 6.

Figure 3:
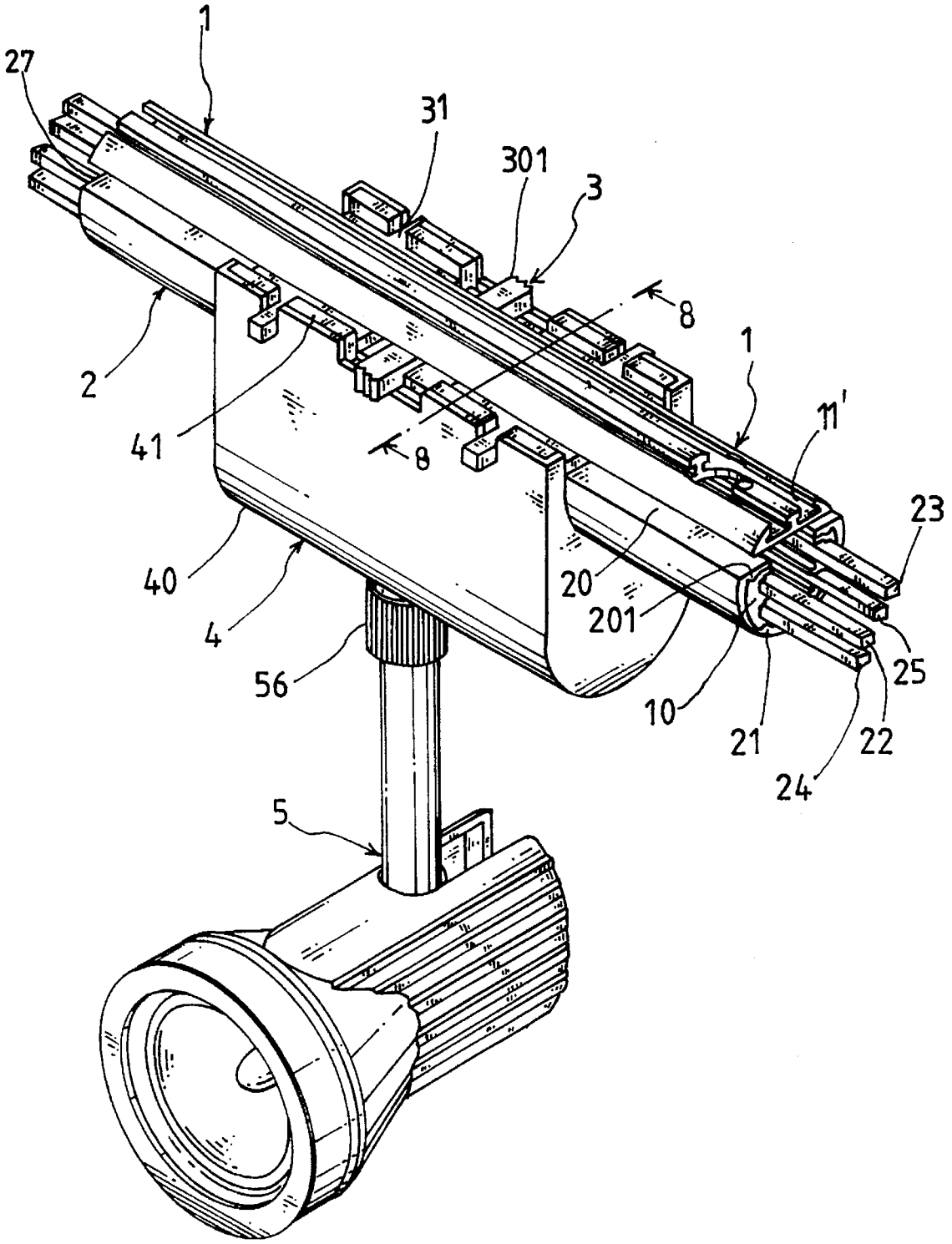
FIG. 3 is an elevational view of the track light shown in FIG. 1.
Figure 4:
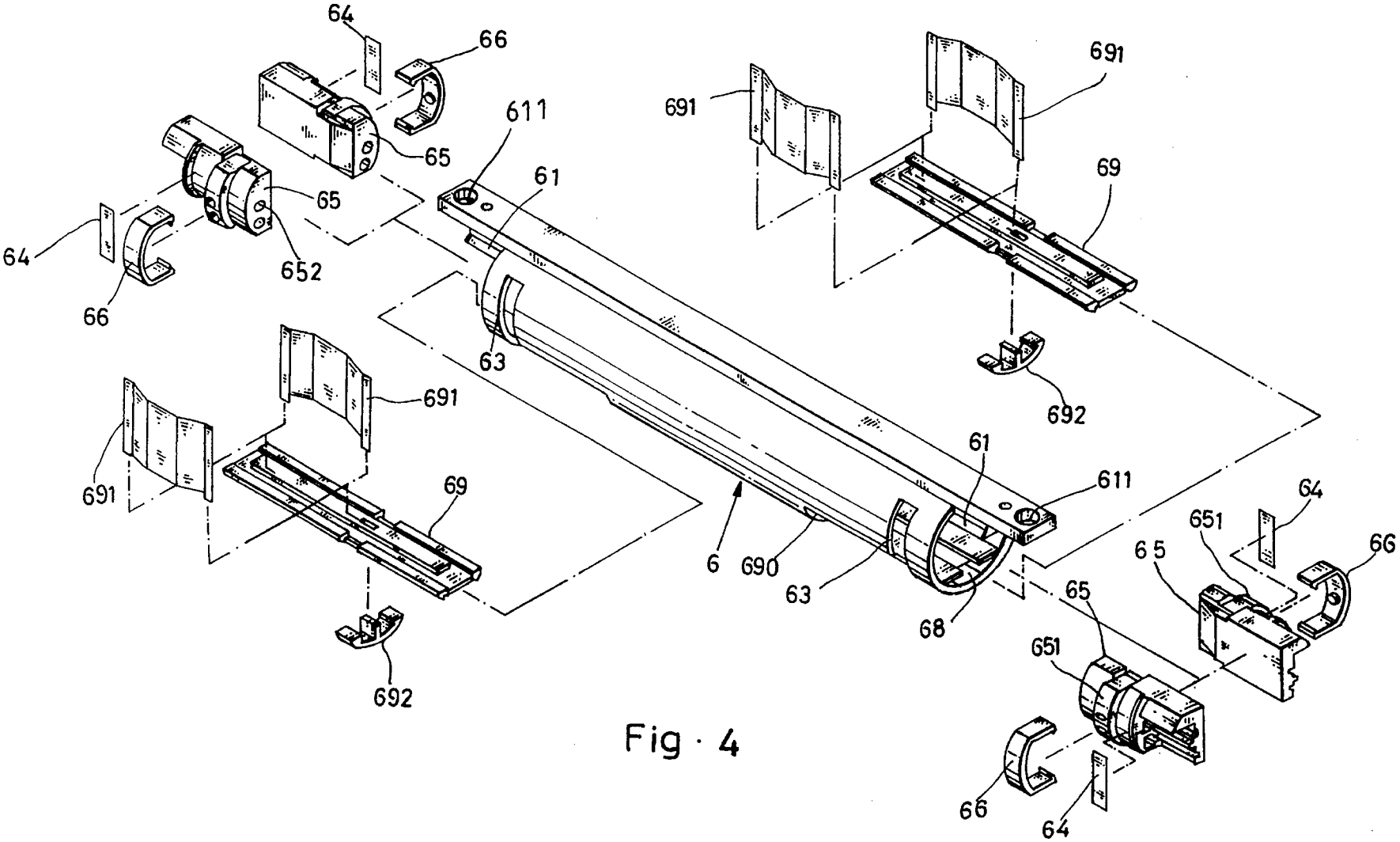
FIG. 4 is an exploded view of a coupler according to the present invention.
Figure 5:
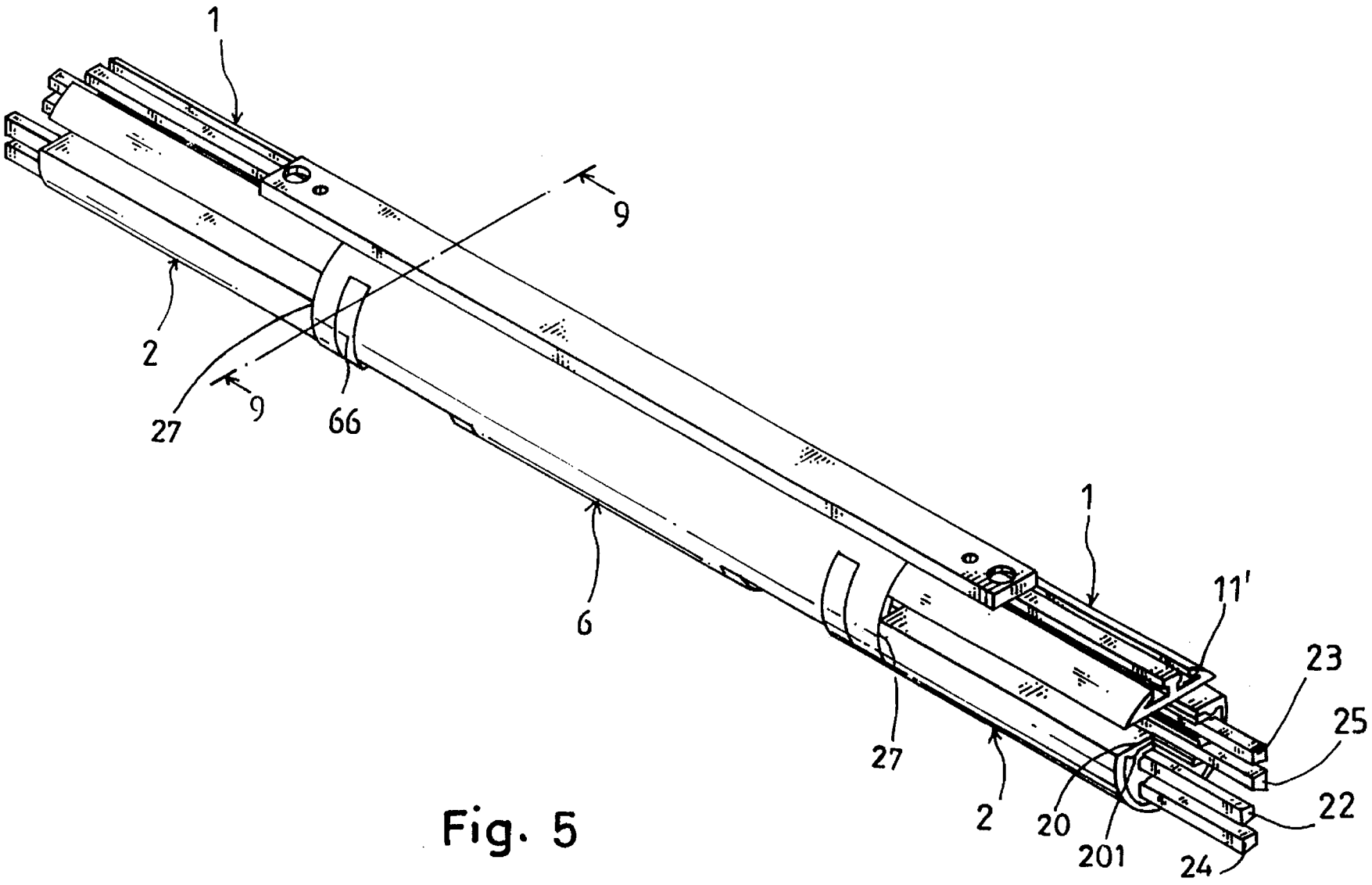
FIG. 5 is an installed view of the coupler of FIG. 4, showing the coupler fastened to the track and locating frame of the track light shown in FIG. 3.
Figure 8:
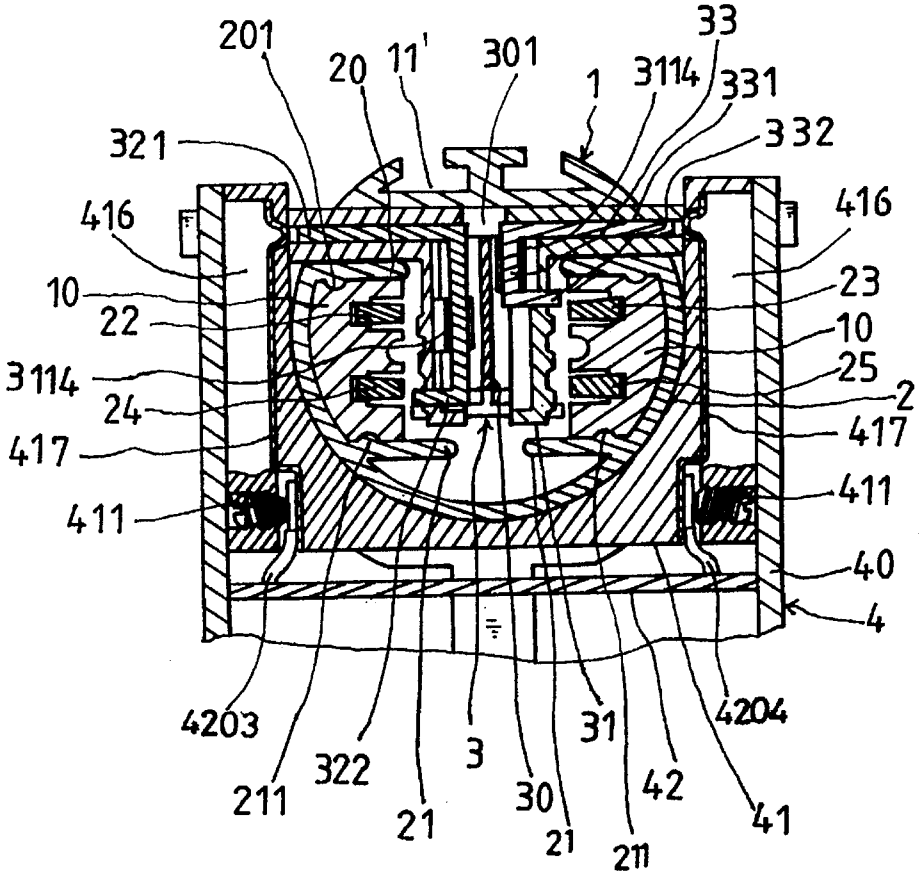
FIG. 8 is a sectional view in an enlarged scale taken along line 8—8 of FIG. 3.
Figure 9:
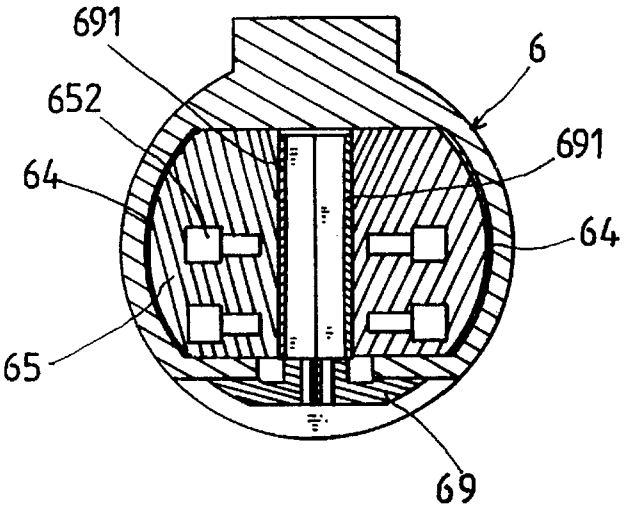
FIG. 9 is a sectional view in an enlarged scale taken along line 9—9 of FIG. 5.
Figure 10:
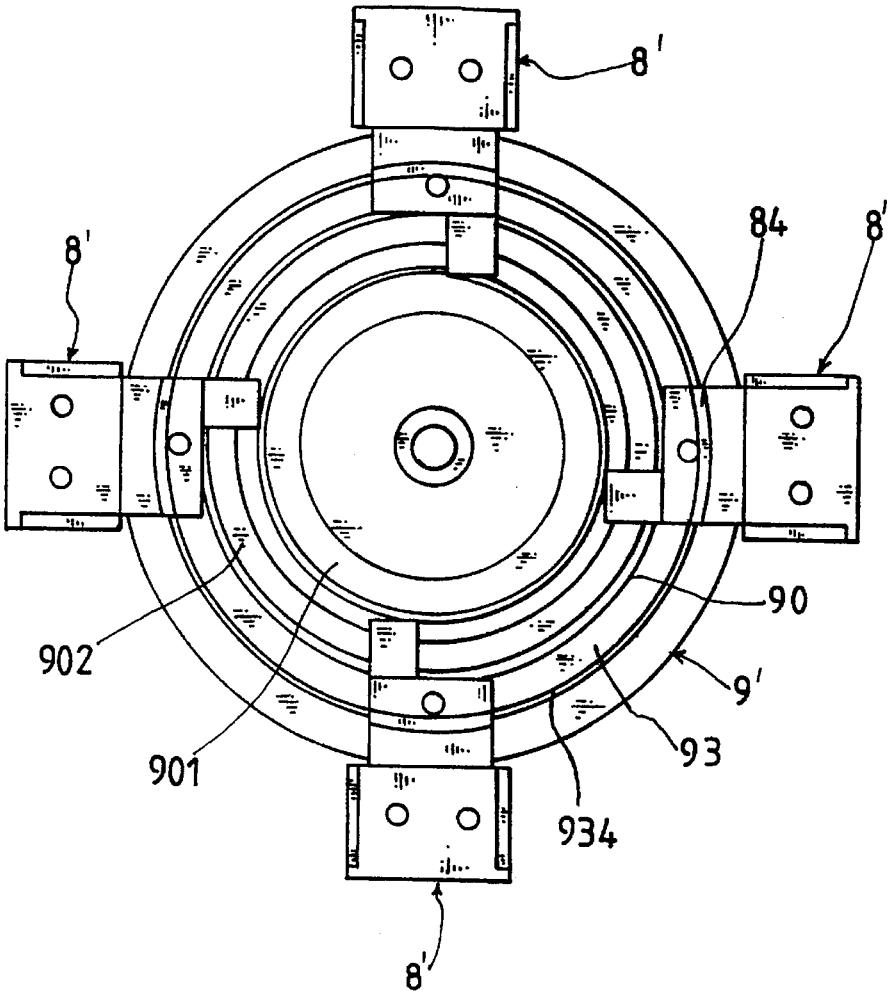
FIG. 10 shows four connecting devices electrically connected to a distribution box in different directions according to the present invention.
Figure 11:
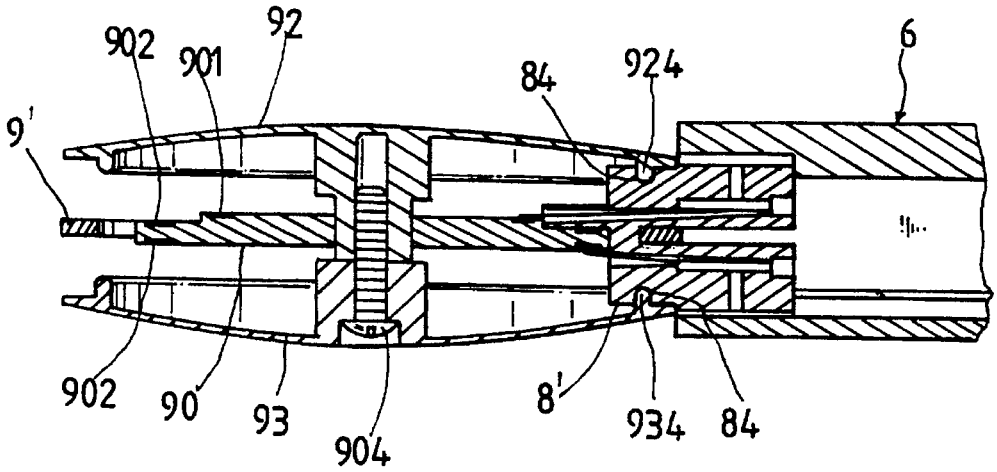
FIG. 11 is a sectional view taken along line 11—11 of FIG. 6.
Figure 12:
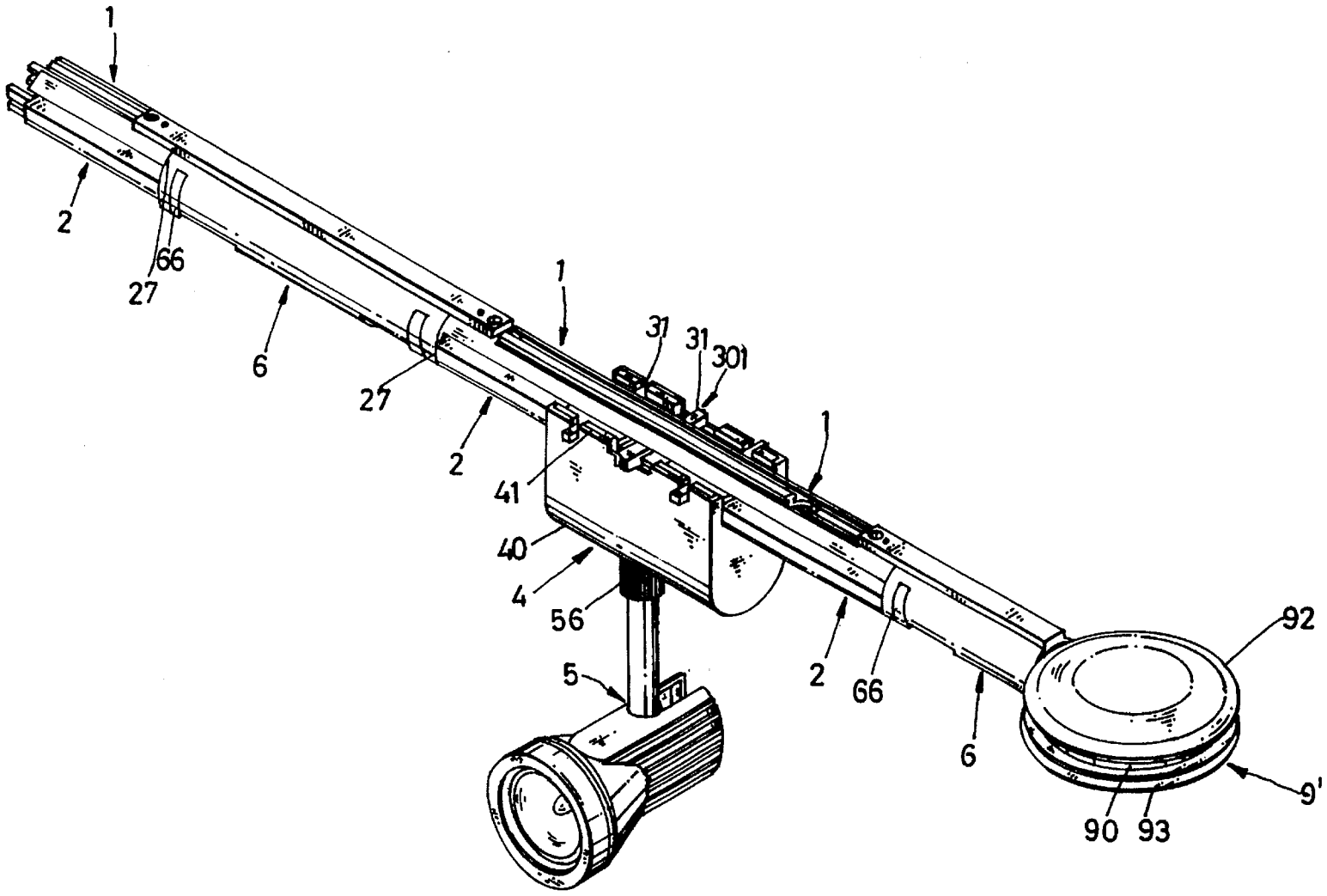
FIG. 12 is a perspective assembly view of FIGS. 3, 5 and 6.

The track 2 is shaped like a U-channel having two longitudinal partition boards 21 with a respective upward rib 211 bilaterally disposed on the inside, two downward ribs 201 respectively raised from two opposite top walls 20 thereof at the bottom (please refer to FIGS. 3 and 8). By means of the upward ribs 211 and the downward ribs 201, an insulator 10 is fastened to the track 2 on the inside thereof to hold two vertically spaced pairs of conductors 22, 23, 24 and 25. The conductors 22, 23, 24 and 25 are respectively partially extended out of the insulator 10 along the length of the track 2. A slide way 26 is defined between the conductors 22, 23, 24 and 25 for mounting the sliding switch 3 permitting the bottoms 322 and 332 of the two opposite pairs of metal contact springs 32 and 33 of the sliding switch 3 to be disposed in contact with the condutors 22, 23, 24 and 25 respectively. The track 2 further comprises two opposite coupling portions 27 for mounting the mounting blocks 651 of the wire holders 65 of the connecting device (or coupler) 6.

The sliding switch 3 comprises a sliding base 30, a switching unit 31, and two pairs of metal contact springs 32 and 33. The sliding base 30 comprises a transverse top rod 301 moved above the track 2, and a bottom contact block 303 connected to the transverse top rod 301 and moved in the slide way 26 to bias the metal contact springs 32 and 33 causing the bottoms 322 and 332 of the metal contact springs 32 and 33 to constantly contact with the conductors 22, 23, 24 and 25 respectively. The bottom contact block 303 has an open chamber 3031 in the middle.

The characteristics of the present invention are outlined hereinafter. The metal contact springs 32 ad 33 of the switching unit 31 of the sliding switch 3 have a respective top section 321 or 331 respectively disposed in contact with the two opposite pairs of metal contact plates 417. The switching unit 31 of the sliding switch 3 includes two symmetrical halves 311. The symmetrical halves 311 are connected together by fastening the hooked portion 3111 on one half to the retaining hole 3112 on the other. Each half 311 of the switching unit 31 comprises two slots 3113 and two locating grooves 3116 and 3116'. Two spring plates 3114 are respectively mounted on the locating grooves 3116 and 3116' of each half 311 to hold one pair of the metal contact springs 32 and 33. Each half 311 of the switching unit 31 further comprises a plurality of projecting rods 3115 horizontally disposed at the top thereof for fastening to respective mounting holes 415 on the connecting block 41 of the electric box 4.

The electric box 4 comprises a casing 40, a connecting block 41, and a circuit board 42. The connecting block 41 and the circuit board 42 are fastened inside the casing 40 on the inside by screws 44. The connecting block 41 comprises a plurality of mounting holes 415. By fitting the projecting rods 3115 of the switching unit 311 into the mounting holes 415 of the connecting block 41, the electric box 4 is coupled to the sliding switch 3 and can be moved the sliding switch 3 on the track 2. The connecting block 41 further comprises two pairs of spring chambers 416, which receive a respective metal contact plate 417. The metal contact plates 417 are respectively connected to four power terminals 4201, 4202, 4203 and 4204 on the circuit board 42 by metal screws 411. The casing 40 comprises a connector holder 420 at the bottom to hold an electric connector 421. The electric connector 421 comprises an outer thread 4213 threaded into the internally threaded socket 56 of the lamp assembly 5, two contact rods 4211 and 4212 respectively connected to the positive and negative poles of the circuit board 42 and disposed in contact with the contact rods 511 and 512 of the electric connector 51 of the lamp assembly 5 (see FIGS. 1 and 2).

The lamp assembly 5 comprises an internally threaded socket 56 fastened to the electric connector 21 of the electric box 4, and an electric connector 51 received inside the internally threaded socket 56 and having two contact rods 511 and 512 respectively disposed in contact with the contact rods 4211 and 4212 of the electric connector 421 of the electric box 4.

The coupler 6 (see FIGS. 4 and 5) comprises a plurality of mounting holes 611 for fastening to the ceiling by screws or the like (not shown), two opposite projecting strips 61 respectively fitted into the retaining grooves 11' on the locating frame 1, two opposite chambers 63, two pairs of wire holders 65 fastened at two opposite ends thereof to hold two pairs of spring plates 64 in the chambers 63. The wire holders 65 comprise mounting blocks 651 respectively fastened to the track 2 and wire grooves 652 for passing the conductors 22, 23, 24 and 25 of the track 2, which are covered with cover plates 66. The coupler 6 further comprises two longitudinal sliding way 68 on the inside, two locating plates 69 mounted in the slide ways 68, two pairs of metal contact spring plates 691 respectively mounted on the locating plates 69 at the top, and two adjusting blocks 692 respectively mounted on the locating plates 69 at the bottom. By means of the adjusting blocks 692, the locating plates 69 can be reciprocated in holes 690 on the bottom of the coupler 6 along the slide ways 68 to control the connection between the metal contact spring plates 691 and the conductors 22, 23, 24 and 25.

Figure 6:
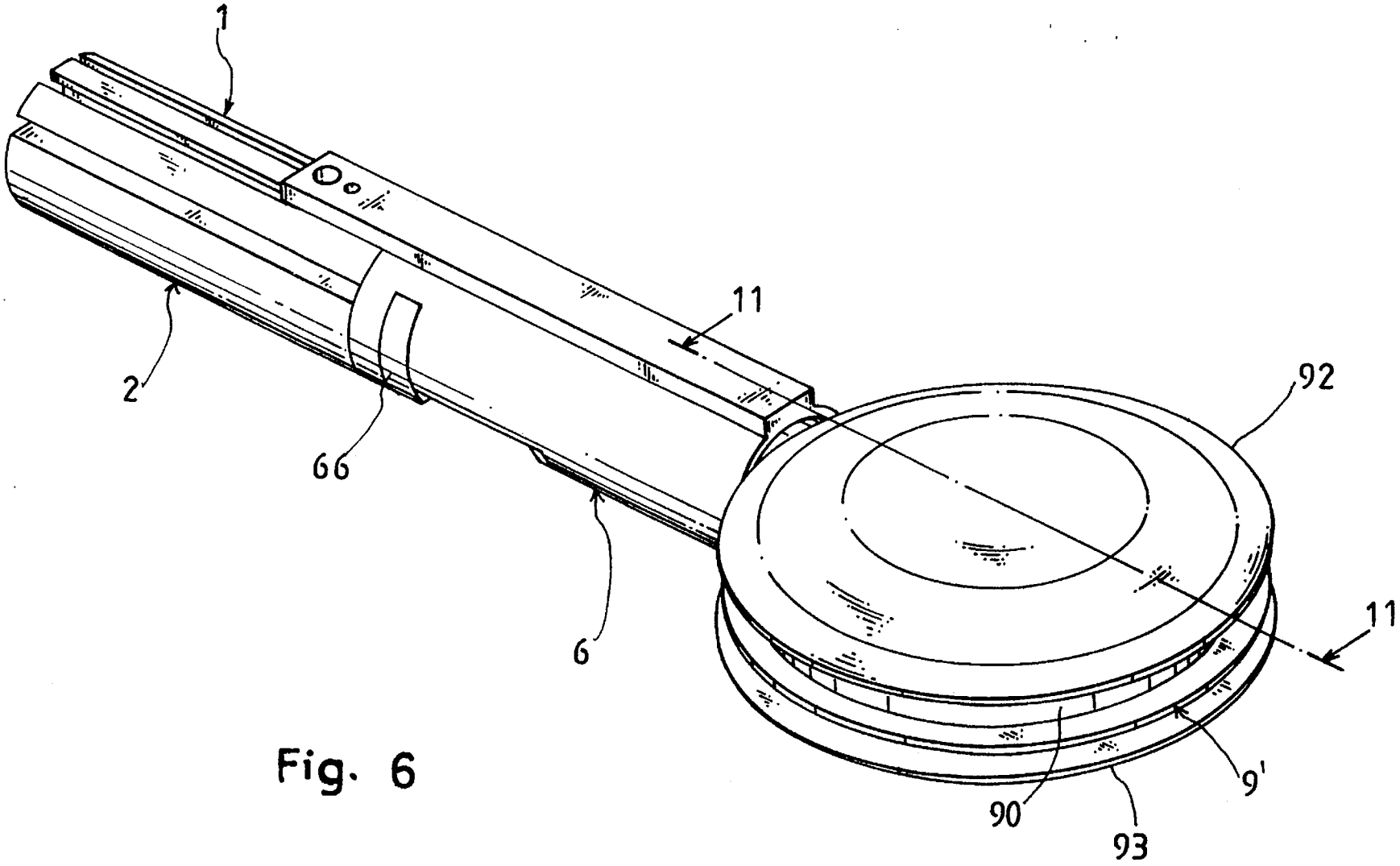
FIG. 6 shows a distribution box fastened to the coupler of FIG. 5.
Figure 7:
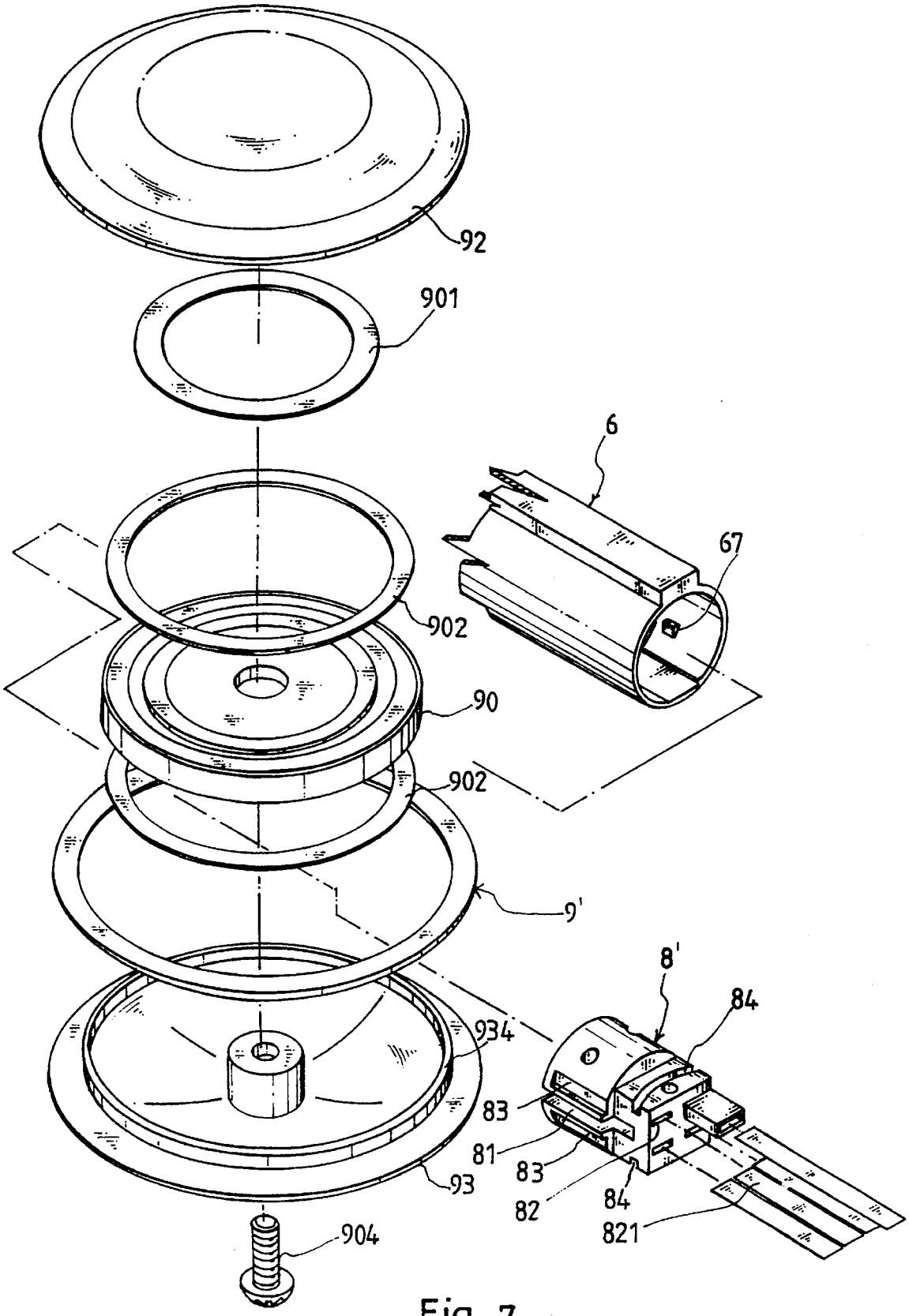
FIG. 7 is an exploded view of FIG. 6.

Referring to FIGS. 6 and 7, the coupler 6 comprises a plurality of projecting blocks 67 bilaterally raised from the inside wall and respectively fitted into opposite mounting grooves 83 on a connecting device 8'. The connecting device 8' comprises four wire slots 82, four contact metal plates 821 respectively fastened to the wire slots 82, a plurality of mounting grooves 83 disposed at two opposite sides and respectively fastened to the projecting blocks 67 inside the coupler 6, a mounting hole 81 and two opposite locating grooves 84 for mounting a circular distribution box 9' (see FIGS. 10 and 11). The distribution box 9' comprises a top shell 92, a bottom shell 93, a conductor holder 90 fastened between the top and bottom shells 92 and 93 by a screw 904, and two opposite pairs of ring conductors 901 and 902 mounted on the conductor holder 90 at two opposite sides and covered by the top and bottom shells 92 and 93. When assembled, the inside annular flanges 924 and 934 of the top and bottom shells 92 and 93 are respectively fastened to the locating grooves 84 of the connecting device 8', the conductor holder 90 is fastened to the mounting hole 81 of the connecting device 8', and the contact metal plates 821 of the connecting device 8' are respectively connected to the ring conductors 901 and 902 of the distribution box 9'.

When the track light is installed, the lamp assembly 5 and the wire box 4 can be moved along the track 5. When the sliding switch 3 is moved forwards, the bottoms 322 and 332 of the front pair of metal contact springs 32 and 33 are forced by the bottom contact block 303 to contact the front pair of conductors 23 and 24, and at the same time the top sections 321 and 331 of the front pair of metal contact springs 32 and 33 of the sliding switch 3 are forced to contact the two front metal contact plates 417 of the connecting block 41 of the electric box 4 and to further electrically connect to the power terminals 4203 and 4204. When the sliding switch 3 is moved backwards, the bottoms 322 and 332 of the rear pair of metal contact springs 32 and 33 are forced by the bottom contact block 303 to contact the rear pair of conductors 22 and 25, and at the same time the top sections 331 and 321 of the rear pair of metal contact springs 33 and 32 of the sliding switch 3 are forced to contact the metal screws 411 of the connecting block 41 of the electric box 4 and to further electrically connect to the power terminals 4201 and 4202.

I claim:

1. A track light comprising a locating frame, a track, a sliding switch, an electric box, a lamp assembly, and a coupler, wherein:

said electric box comprises a transformer, metal contact plates, and other electric parts for providing power supply to the track light for operation;

said locating frame comprises two opposite retaining grooves, which receive two opposite projecting strips of the coupler; when the projecting strips are respectively fastened to the retaining grooves, the locating frame can then be coupled to the track by the coupler;

said track is shaped like a U-channel having two longitudinal partition boards with a respective upward rib bilaterally disposed inside thereof, two downward ribs respectively raised from two opposite top walls of the U-shaped panels at the bottom thereof; by means of the upward ribs and the downward ribs, an insulator is fastened to the track on the inside to hold two vertically spaced pairs of conductors; the conductors are respectively partially extended out of the insulator along the length of the track; a slide way is defined between conductors for mounting sliding switch permitting the bottoms of the two opposite pairs of metal contact springs of the sliding switch to be disposed in contact with the conductors respectively; the track further comprises two opposite coupling portions for mounting mounting blocks of wire holders of the connecting device;

said sliding switch comprises a sliding base, a switching unit, and two pairs of metal contact springs; the sliding base comprises a transverse top rod moved above the track, and a bottom contact block connected to the transverse top rod and moved in the slide way to bias the metal contact springs causing the bottoms of the metal contact springs to be constantly disposed in contact with the conductors, respectively; a bottom contact block has an open chamber in the middle;

said metal contact springs of the switching unit of the sliding switch have a respective top section respectively disposed in contact with the two opposite pairs of metal contact plates; the swtiching unit of the sliding swtich consists of two symmetrical halves; the symmetraicl halves are connected together by fastening a hooked portion on one half to a retaining hole on the other; each half of the switching unit comprises two slots and two locating grooves; two spring plates are respectively mounted on the locating grooves of each half to hold one pair of the metal contact springs; each half of the switching unit further comprises a plurality of projecting rods horizontally disposed at the top for fastening to respective mounting holes on the connecting block of the electric box;

said electric box comprises a casing, a connecting block, and a circuit board; the connecting block and the circuit board are fastened to the casing on the inside by screws; the connecting block comprises a plurality of mounting holes; by fitting the projecting rods of the switching unit into the mounting holes of the connecting block, the electric box is coupled to the sliding switch and can be moved with the sliding switch on the track; the connecting block further comprises two pairs of spring chambers, which receive a respective metal contact plate; the metal contact plates are respectively connected to four power terminals on the circuit board by metal screws; the casing comprises a connector holder at the bottom to hold an electric connector; the electric connector comprises an outer thread threaded into an internally threaded socket of the lamp assembly, two contact rods respectively connected to positive and negative poles of the circuit board and disposed in contact with the contact rods of the electric connector of the lamp assembly;

said lamp assembly comprises an internally threaded socket fastened to the electric connector of the electric box, and an electric connector received inside the internally threaded socket and having two contact rods respectively disposed in contact with the contact rods of the electric connector of the electric box;

said coupler comprises a plurality of mounting holes for fastening to the ceiling by screws, two opposite projecting strips respectively fitted into the retaining grooves on the locating frame, two opposite chambers, two pairs of wire holders fastened at two opposite ends thereof to hold two pairs of spring plates in the chambers; the wire holders comprise mounting blocks respectively fastened to the track and wire grooves for passing the conductors of the track, and are covered with cover plates; the coupler further comprises two longitudinal slide way on the inside, two locating plates mounted in the slide ways, two pairs of metal contact spring plates respectively mounted on the locating plates at a top thereof, and two adjusting blocks respectively mounted on the locating plates at a bottom thereof; by means of the adjusting block, the locating plates can be reciprocated in holes on the bottom of the coupler along the slide ways to control the connection between the metal contact spring plates and the conductors.

2. The track light of claim 1 wherein said coupler comprises a plurality of projecting blocks bilaterally raised from the inside wall and respectively fitted into opposite mounting grooves on a connecting device; the connecting device comprises four wire slots, four contact metal plates respectively fastened to the wire slots, a plurality of mounting grooves dispoped at two opposite sides and respectively fastened to the projecting blocks inside the coupler, a mounting hole and two opposite locating grooves for mounting a circular distribution box; the distribution box comprises a top shell, a bottom shell, a conductor holder fastened between the top and bottom shells and by a screw, and two opposite pairs of ring conductors mounted on the conductor holder at two opposite sides and covered by the top and bottom shells; when assembled, inside annular flanges of the top and bottom shells are respectively fastened to the locating grooves of the connecting device, the condutor holder is fastened to the mounting hole of the connecting device, and the contact metal plates of the cnnecting device are respectively connected to the ring conductors of the distribution box.

* * * * *